United States Patent [19]

Lebet

[11] 4,164,438

[45] Aug. 14, 1979

[54] METHOD OF MAKING TRANSVERSE FLOW OF CIGARETTE FILTERS

[75] Inventor: Jean-Pierre Lebet, Montreux, Switzerland

[73] Assignee: Baumgartner Papiers S.A., Switzerland

[21] Appl. No.: 839,607

[22] Filed: Oct. 5, 1977

[30] Foreign Application Priority Data

Oct. 5, 1976 [CH] Switzerland ..... 12568/76

[51] Int. Cl.[2] ..... B29C 17/00; A24C 5/50

[52] U.S. Cl. ..... 156/180; 93/1 C; 131/267; 131/268; 156/193; 156/194; 156/219; 156/250; 156/242; 264/148; 264/157; 264/293; 264/294

[58] Field of Search ..... 93/1 C; 131/264–269; 156/166, 175, 178, 181, 196, 213, 242, 180, 193, 194, 209, 441, 219, 250; 264/136, 148, 157, 280, 284, 293

[56] References Cited

U.S. PATENT DOCUMENTS

| | | | |
|---|---|---|---|
| Re. 29,674 | 6/1978 | Labbe et al. | 264/151 |
| 2,954,773 | 10/1960 | Lebet | 264/151 |
| 3,093,142 | 6/1963 | Swerdloff et al. | 131/268 |
| 3,164,242 | 1/1965 | Schubert et al. | 93/1 C |
| 3,164,243 | 1/1965 | Rudszinat et al. | 93/1 C |
| 3,313,306 | 4/1967 | Berger et al. | 131/10.7 |
| 3,735,672 | 5/1973 | Molins et al. | 93/1 C |
| 3,774,508 | 11/1973 | Berger | 93/1 C |
| 3,805,682 | 4/1974 | Lyon et al. | 93/1 C |
| 3,994,306 | 11/1976 | Berger | 131/265 |
| 4,024,001 | 5/1977 | Lyon et al. | 93/1 C |
| 4,075,936 | 2/1978 | Berger | 93/1 C |

*Primary Examiner*—W. E. Hoag

*Attorney, Agent, or Firm*—Robert E. Burns; Emmanuel J. Lobato; Bruce L. Adams

[57] ABSTRACT

A method of making a filtering member of cellulose acetate for cigarette filters of the transverse flow type in which a rod formed by a bunch of cellulose acetate fibres coated with plasticizing agent and surrounded by a skin or a paper cover is first cut transversely into shorter lengths at a cutting station. Then with each length in a heated state, a plurality of similar, spaced, co-linear grooves are impressed into the length along each of two diametrically opposed sides thereof as the length is carried by a conveyor arrangement from the cutting station to a processing station. The conveyor arrangement can comprise a driven train of fluted transfer drums receiving the lengths in the flutes certain of which have teeth extending along the troughs of those flutes to impress the grooves in the lengths, or can comprise a conveyor belt to receive the lengths in which the grooves are impressed by punches above and below the upper run of the belt.

13 Claims, 11 Drawing Figures

FIG.6
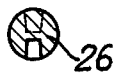
FIG.5
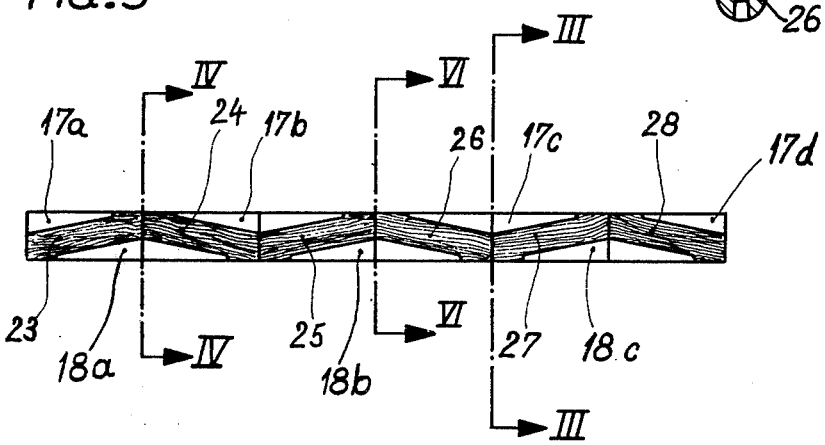
FIG.8
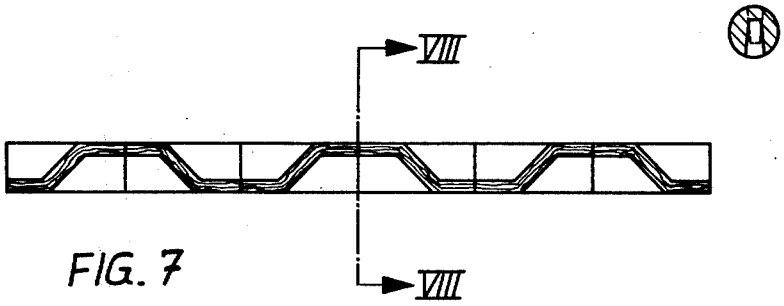
FIG. 7
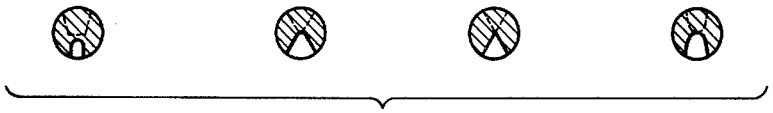
FIG.9

METHOD OF MAKING TRANSVERSE FLOW OF CIGARETTE FILTERS

FIELD OF THE INVENTION

The present invention relates to a method for the manufacture of a filtering member of cellulose acetate for cigarette filters of the type having a transverse flow, known under the name of "cross-flow" filters, i.e. comprising at least one filtering part extending obliquely and transversely with respect to the body of the filter in order to form at least two chambers separated by the filtering member, according to which the cellulose acetate previously impregnated with a plasticizing agent is pressed and shaped when hot and from which a bunch or rod is formed on which a skin has been formed or which has been wrapped in a porous paper.

BACKGROUND OF THE INVENTION

A filter of the "cross-flow" type is described in U.S. Pat. No. 3,533,416. Its advantages reside in a substantially higher power of retention than normal filters, without a pressure drop. A device for the shaping of such filtering members is described in U.S. Pat. No. 3,826,177. In this device, the rod of cellulose acetate, previously coated with a plasticizing agent and heated by means of water vapour, passes between a set of shaping wheels, then it is cut into filter sections. Since cutting takes place after shaping of the members, it is necessary that the cut occurs exactly between successive members, which requires very accurate synchronization of the shaping members and cutting members and an absolutely uniform feed of the rod. If these conditions are not satisfied, even momentarily, this results in waste which may be very considerable.

SUMMARY OF THE INVENTION

The precise object of the present invention is to prevent the formation of waste due to faulty synchronization, thus making the cut independent of the shaping process, which also makes it possible to simplify the control arrangement. To this end, one makes use of the fact that approximately 15 to 20 minutes are available for a shaping operation, at ambient temperature, between plasticization of the cellulose acetate and its solidification. The method of manufacture of a filtering member according to the invention is characterised in that the cellulose acetate rod is firstly cut into sections, then these sections are shaped during their conveyance to an adjacent discharge or processing station.

The invention also relates to an installation for carrying out the above-described method, characterised in that it comprises means for cutting the previously formed cellulose acetate rod, means for transferring the sections obtained and shaping means located in these transfer means.

DESCRIPTION OF PREFERRED EMBODIMENTS

The accompanying drawings illustrate, as an example, one embodiment, as well as a variation of an installation for carrying out the method according to the invention.

FIG. 5 shows the profile of the filter after shaping as well as the profile of the shaping tools.

FIG. 6 is a sectional view on line VI—VI of FIG. 5.

FIG. 7 shows a variation of the profile of the filter and shaping tools.

FIG. 8 is a sectional view on line VIII—VIII of FIG. 7.

FIG. 9 shows four variations of cross sections of the filter and shaping tools.

DESCRIPTION OF PREFERRED EMBODIMENTS

Figure 1:
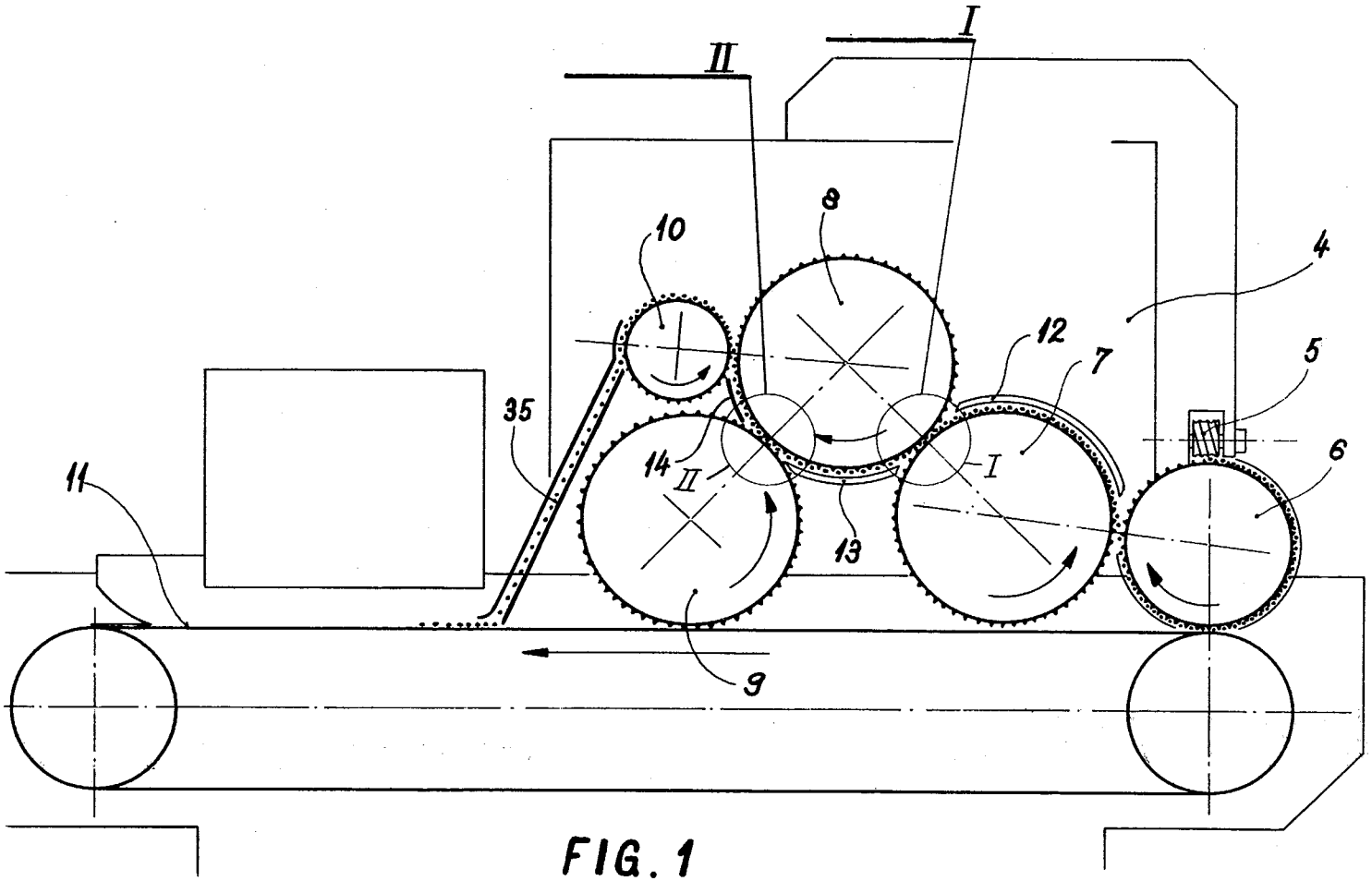
FIG. 1 is a diagrammatic elevational view of the installation.
Figure 2:
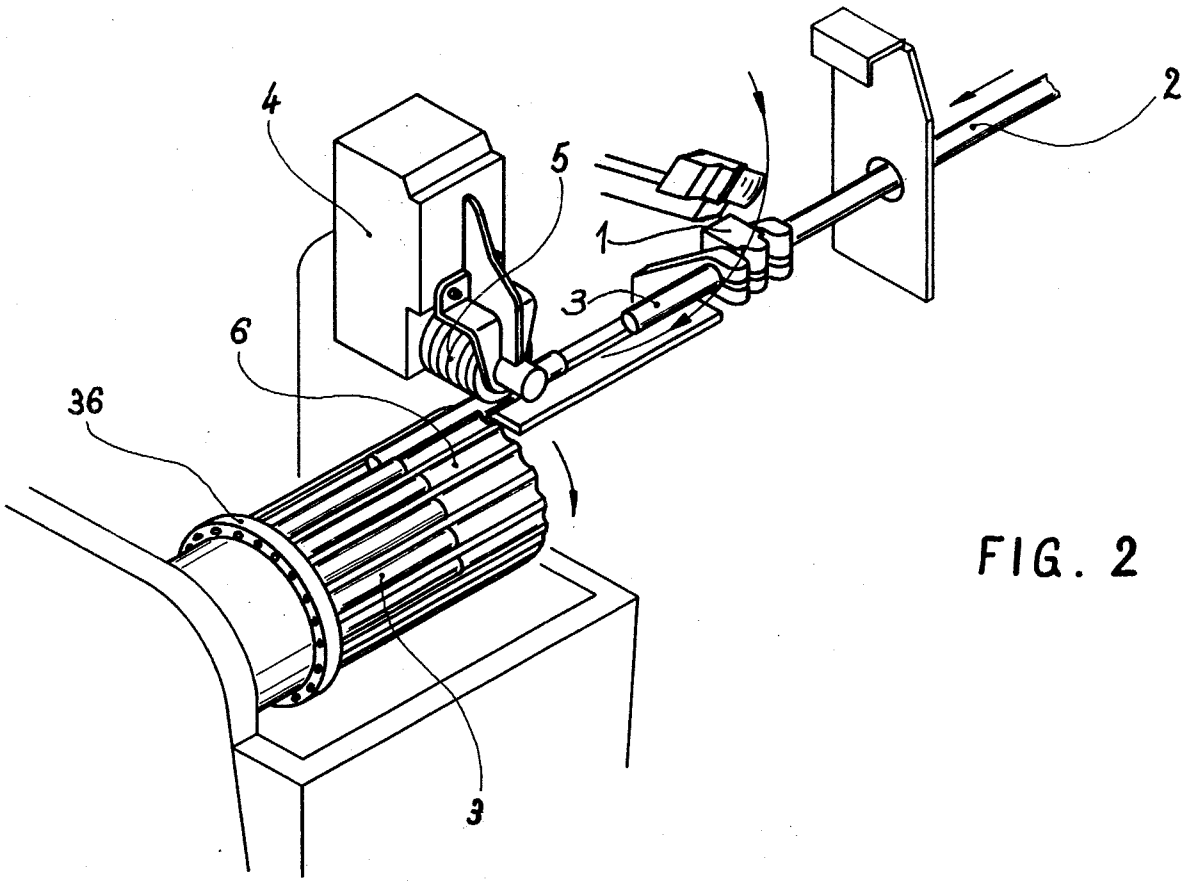
FIG. 2 is a perspective view of the inlet of the installation.

At its inlet, the installation shown in FIGS. 1 and 2 comprises essentially a cutting device 1 known per se, for dividing the rod 2 into sections. This rod is formed in manner known per se, from cellulose acetate fibres coated with a plasticizer then heated by any known means, such as vapour or hyperfrequencies. It is covered in a porous paper or coated with a skin formed by superheating as described in U.S. Pat. No. 3,455,766. The cutting device cuts the rod 2 into small rods 3 whose length corresponds to several lengths of filter, under the circumstances six lengths. The frame 4 supports a wheel 5 whose periphery comprises a helical groove whose axis coincides with the axis of the wheel 5. The wheel 5, also known as a helical spacer, rotates in the immediate vicinity of the grooves or channels of a first grooved drum 6 known as a deflector drum. This deflector drum 6 ensures the uniform and continuous distribution of small rods 3. It comprises an annular edge 36 against which the small rods abut. A device of this type is described in detail in Swiss Pat. No. 570,320 so that its description will not be repeated again in detail. As regards the helical spacer 5, which does not appear in the device described in Swiss Pat. No. 570,320, its function is to facilitate the transformation of the longitudinal movement of the small rods 3 into a transverse movement resulting from their entrainment by the grooves of the deflector drum 6.

The shaping device is constituted by a first grooved drum 7 constituting a counter punch, a second grooved drum 8 constituting a first punch and by a third grooved drum 9 constituting a second punch. The installation also comprises a grooved transfer drum 10 on which the small shaped rods are retained by vacuum as on the drum 6. This drum 10 is a simple transfer drum on which these small rods are retained by vacuum, then released at the end of approximately half a revolution in the same manner as on the drum 6, as described in Swiss Pat. No. 570,320. The installation also comprises a discharge chute 35 leading to a conveyor belt 11 for the discharge of the small rods to a packing device or to another machine in the case where the filtering members are introduced into composite filters. The moving parts 5 to 10 are integral with gears which are not shown, by which they are set in simultaneous and synchronous rotation. In addition to their shaping function, i.e. their role as punches, the drums 8 and 9 ensure the transfer of the small rods, in the same way as the drums 6, 7 and 10 and this constitutes one of the original features of the device. On the drums 7 and 8, the small rods are not retained by vacuum, but by deflecting plates 12, 13 and 14 following the circumference of the drums.

Figure 3:
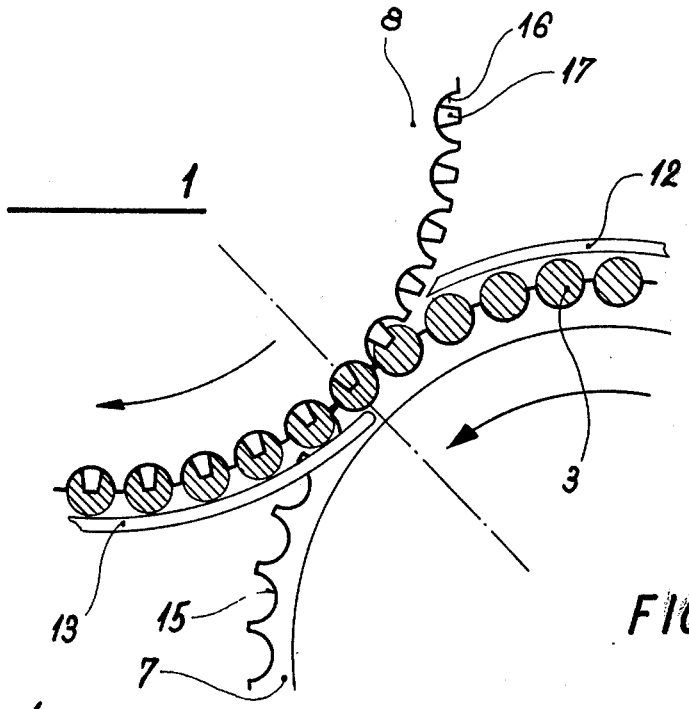
FIG. 3 shows a detail of the parts of a first shaping stage.
Figure 4:
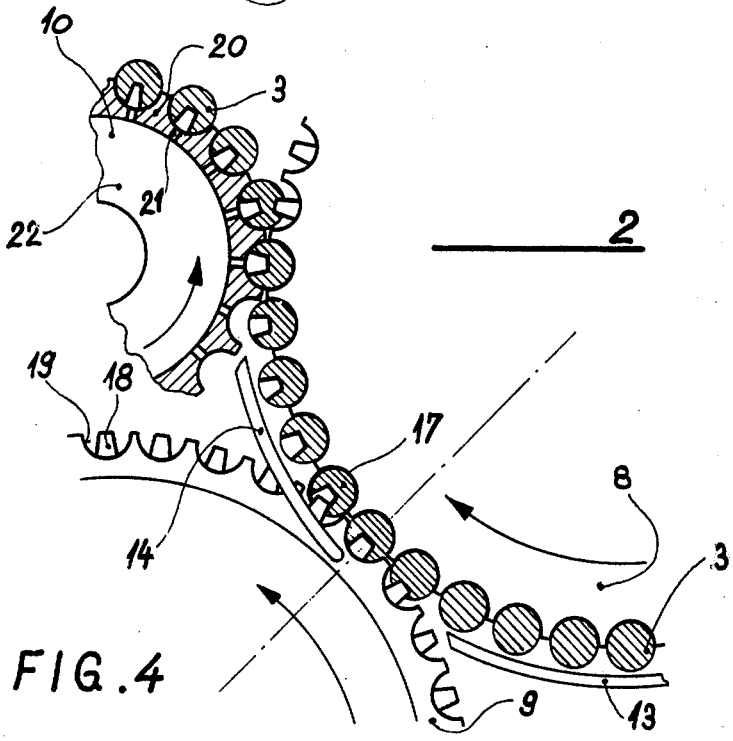
FIG. 4 shows a detail of the parts of a second shaping stage.

Owing to the method of shaping on rotating parts, the shaping process necessarily takes place in two stages, in two areas indicated by the circles I and II. These shaping areas are shown in detail in FIGS. 3 and 4 respectively. FIG. 3 shows that the grooves 15 of the drum 7 have an approximately semi-cylindrical profile over their entire length, whereas the grooves 16 of the drum 8 comprise projections 17. Depending on the direction of the groove, the longitudinal profile of these projections may have the shape shown in FIG. 5 for example. There are four projections, namely 17*a*, 17*b*, 17*c* and 17*d*. Since the grooves 15 are smooth, the projections 17*a* to 17*d* may occupy any position with respect to the grooves 15. On the other hand, in stage II shown in FIG. 4, these projections 17 should have a shape interacting with that of the projections 18, the shapes of which are similar to those of the projections 17, provided in the grooves 19 of the drum 9. The shape and position of the projections 18 with respect to the position of the projections 17 is visible in FIG. 5 where it can be seen that there are three projections 18*a*, 18*b* and 18*c* per groove 19. The section lines III—III and IV—IV correspond respectively to FIGS. 3 and 4. Both in stage I as well as stage II, it is necessary, as shown in FIGS. 3 and 4, that the grooves 15 and 16 on the one hand and the grooves 16 and 19 on the other hand are exactly opposite each other when the grooved drums come into approximate tangential contact one with the other. This condition of coincidence is naturally valid for the drums 6 and 10. FIG. 4 also shows that holes 21 are provided through the casing 20 of the drum 10, which holes communicate with an inner chamber 22 in which reduced pressure prevails sufficient to keep the shaped rods 3 on the transfer drum 10. Instead of being retained by reduced pressure, it is naturally also possible to use plates similar to the plates 12 to 14, but since the technique of retention by reduced pressure is known and has been completely mastered, this solution proves simple and effective.

The installation operates in the following manner: After cutting into sections at 1, the small rods 3 obtained are transferred to the groove drum 6 by means of the helical spacer 5. The direction of rotation of the drums 6 to 10 is indicated by the arrows. The small rods 3 are then transferred to the drum 7 at the point of contact of these two first drums. When the rods arrive opposite the drum 8, they are engaged between these two drums and undergo a first shaping operation corresponding to the profile 17*a* to 17*d*. They are then entrained by the drum 8 in order to be engaged between the drums 8 and 9 where they undergo a second shaping operation according to the profile 18*a* to 18*c*. The shaped rods are then discharged by the drum 10 and the conveyor belt 11. At this time, the rod has the shape shown in FIG. 5. It may subsequently be cut into six filter members 23, 24, 25, 26, 27 and 28. FIG. 6 shows the shape of the end of the filter 26, in end view. When one of these filtering members, for example the member 26 is surrounded by a cylindrical casing, it forms an oblique separation between two chambers corresponding to the impressions 17*a*, 18*a*.

The profile and section shown in FIGS. 5 and 6 are in no way limiting. Numerous other shapes may be obtained in the same way.

FIGS. 7 and 8 show another profile and another section, by way of example.

FIG. 9 shows four variations of cross sections at the end of a filter, by way of example. For the same profile, it is possible to have different cross sections.

With this method, it is not only no longer necessary to synchronise the cut with the stamped profile, but positioning of the rods in the shaping tools is ensured automatically by the positioning of these rods on the transfer drums, this positioning being effected on the first drum 6 when the rods 3 abut against the annular edge 36 of this drum.

In view of the fact that cellulose acetate is shaped during its hardening time, the method used also has another important advantage. In fact it is possible to increase the time during which the rods remain in the shaping tools, i.e. the hardening time, by increasing the diameter of the drums without reducing the operating speed, i.e. the feed of the continuous rod and the small shaped rods.

Instead of heating the rod prior to the cut, or in addition to this heating, it is possible to heat the punches, for example by means of electrical resistances.

Figure 10:
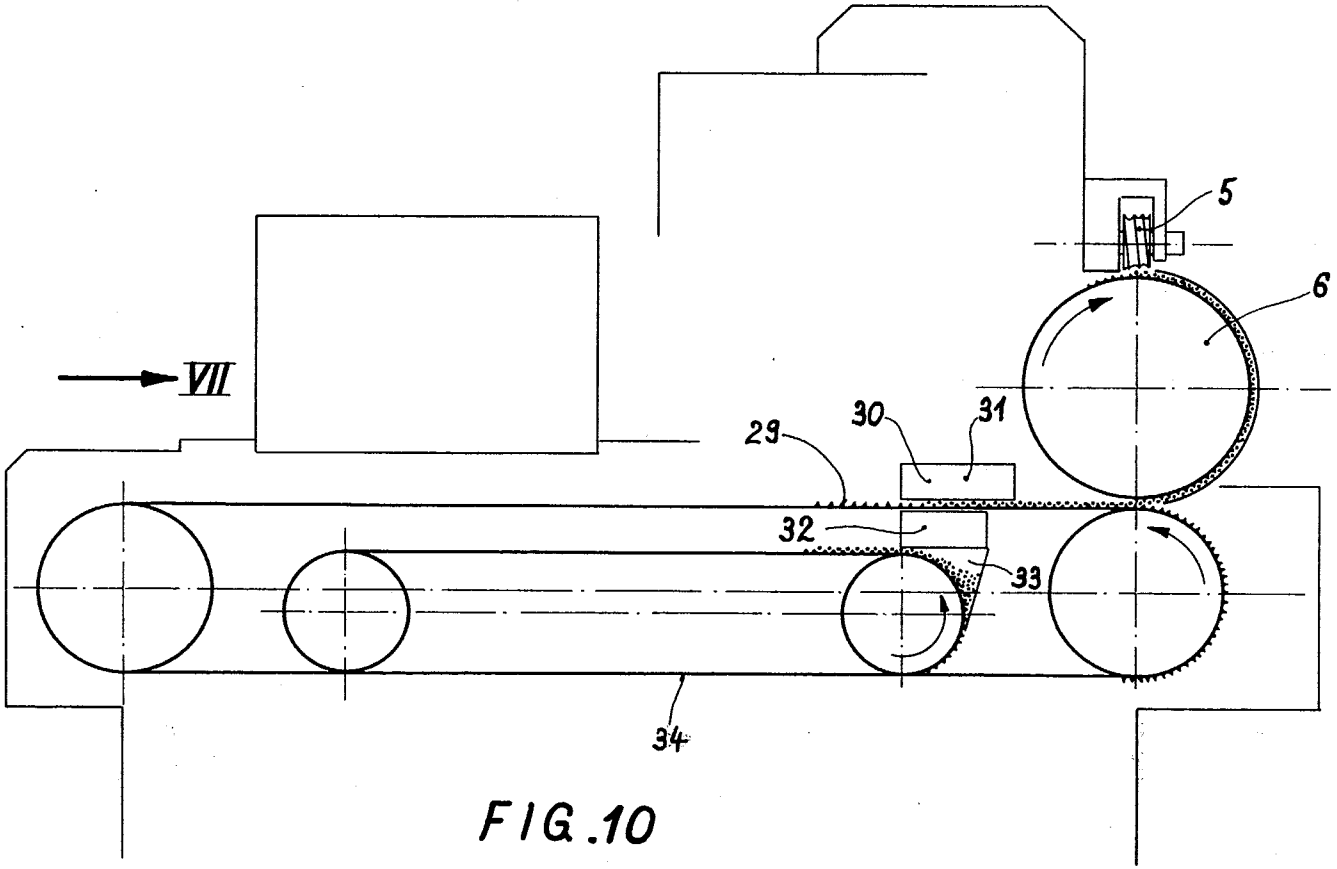
FIG. 10 is a diagrammatic side elevational view of a variation.
Figure 11:
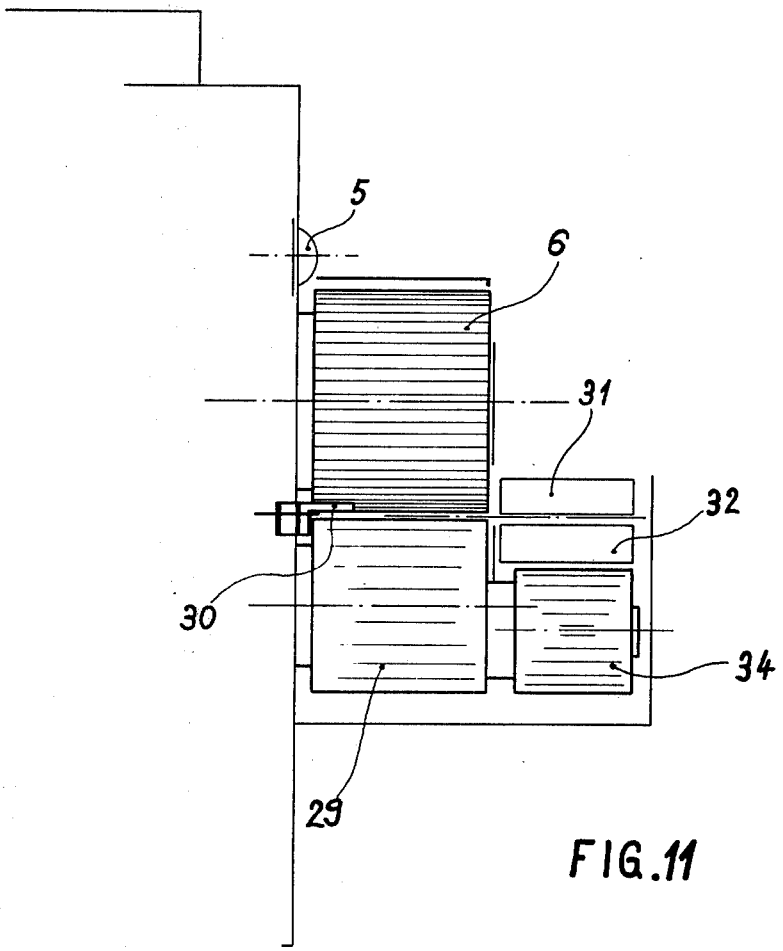
FIG. 11 shows a view of this variation in direction A.

In the embodiment illustrated as a variation in FIGS. 10 and 11, shaping does not take place between two rollers, but the rods are transferred from the deflector drum 6 to a conveyor belt 29 provided with transverse grooves, from which they are driven laterally by means of a compressed air jet 30 between two punches 31 and 32 carrying out a vertical alternating movement. The shaped rod then falls into a hopper 33 leading to a second endless conveyor belt 34 also provided with transverse grooves ensuring an orderly transfer of rods to the next station. If the progress of the rods takes place in a continuous manner on the drum 6 and on the conveyor belts 29 and 34, shaping between the punches 31 and 32 necessarily takes place discontinuously. To this end, the rods are driven periodically in groups from the belt 29 between the punches 31 and 32.

According to a variation which is not shown but very close to the preceding embodiment, the rods are also driven laterally in large groups between two relatively long punches which then ensure their direct transfer to a magazine or package.

The method is clearly applicable to the manufacture of single filters.

What is claimed is:

1. A method of making transverse-flow cigarette filters which comprises:

forming cellulose acetate previously impregnated with a plasticizing agent into a rod having a porous covering, cutting said rod at a cutting station into sections each having the length of several filters, forming indentations in opposite sides of said rod sections while conveying said rod sections from said cutting station and positioning said rod sections by means engaging ends of said rod sections, and cutting said rod sections into individual filter lengths.

2. A method according to claim 1, in which successive, like indentations formed in one side of said rod sections are offset in a longitudinal direction from successive, like indentations formed in the opposite side of said rod sections by a distance equal approximately to half the length of individual indentations.

3. A method according to claim 1, in which indentations are first formed in one side of said rod sections and indentations are then formed in the diametrically opposite side of said rod sections.

4. A method according to claim 1, in which said rod sections are conveyed in a direction transverse to the lengths of said sections.

5. A method according to claim 4, in which said rod sections are conveyed from said cutting station by being fed into and carried by transverse grooves in a belt conveyor.

6. A method according to claim 4, in which said rod sections are conveyed by being fed into and carried by longitudinal grooves in the peripheral surface of a revolving drum.

7. A method according to claim 6, in which said rod sections, after being cut from said rod, are fed successively into longitudinal grooves in the peripheral surface of a first revolving drum, are transferred to longitudinal grooves of a second revolving drum having means therein for forming indentations in one side of said rod sections and are carried into engagement with a third revolving drum having means for forming indentations in the opposite side of said rod sections.

8. A method of making transverse flow cigarette filters which comprises:

forming cellulose acetate previously impregnated with a plasticizing agent into a rod having a porous covering, cutting said rod at a cutting station into sections of predetermined length, conveying said rod section successively from said cutting station in a direction transverse to the lengths of said rod sections, and forming indentations in opposite sides of said rod sections while positioning said rod sections by means engaging ends of said rod sections.

9. A method according to claim 8, in which said rod sections are conveyed by being fed into and carried by longitudinal grooves in the peripheral surface of a revolving drum.

10. A method according to claim 8, in which said rod sections are conveyed from said cutting station by being fed into and carried by transverse grooves in a belt conveyor.

11. A method according to claim 8, in which indentations formed in one side of said rod sections are offset in a longitudinal direction from indentations formed in the opposite side of said rod sections.

12. A method according to claim 8, in which indentations are first formed in one side of said rod sections and indentations are then formed in the diametrically opposite side of said rod sections.

13. A method according to claim 12, in which said rod sections are fed successively into longitudinal grooves in the peripheral surface of a first revolving drum, are transferred to longitudinal grooves of a second revolving drum having means for forming indentation in one side of said rod sections and are carried into engagement with a third revolving drum having means for forming indentations in the opposite side of said rod sections.

* * * * *